United States Patent [19]

Reen

[11] 4,260,418

[45] Apr. 7, 1981

[54] METHOD FOR PRODUCING MOLYBDENUM BEARING FERROCHROMIUM

[75] Inventor: Orville W. Reen, New Kensington, Pa.

[73] Assignee: Allegheny Ludlum Steel Corporation, Pittsburgh, Pa.

[21] Appl. No.: 71,822

[22] Filed: Sep. 4, 1979

[51] Int. Cl.[3] ..... C22C 33/00; B23K 35/34

[52] U.S. Cl. ..... 148/126; 75/130.5

[58] Field of Search ..... 75/130.5, 84, 28, 33, 75/90 R; 148/6.3, 13.1, 126

[56] References Cited

U.S. PATENT DOCUMENTS

| | | | |
|---|---|---|---|
| 2,473,019 | 6/1949 | Erasmus | 75/130.5 |
| 2,473,021 | 6/1949 | Spendelow | 75/130.5 |
| 2,541,153 | 2/1951 | Chadwick | 75/130.5 |
| 2,797,156 | 6/1957 | Saunders | 75/130.5 |
| 3,595,709 | 7/1971 | Sordillo | 75/130.5 |
| 3,635,699 | 1/1972 | Chadwick | 75/130.5 |
| 3,725,051 | 4/1973 | Chadwick | 75/130.5 |
| 4,008,104 | 2/1977 | Nakamura | 148/13.1 |
| 4,050,960 | 9/1977 | Nakamura | 148/16 |
| 4,124,378 | 11/1978 | Kurdowski | 75/130.5 |

OTHER PUBLICATIONS

Chadwick, "Manufacture of Simplex Ferrochrome by the Vacuum Process", Transaction of the Vacuum Metallurgy Conference, pp. 221-231 (1963).

Katayama et al., "Production of Ultra Low Nitrogen Ferrochrome", Transactions of the Iron and Steel Institute of Japan, pp. 347-354 (1979).

*Primary Examiner*—P. D. Rosenberg

*Attorney, Agent, or Firm*—Vincent C. Gioia

[57] ABSTRACT

An improved method for producing a low carbon, low nitrogen ferrochromium containing molybdenum. The method comprises the steps of blending particles of high carbon ferrochromium and particles of an oxygen and molybdenum bearing compound, heat treating the blend in a vacuum at temperatures of 1600° F. or over, and pressures of 10 torr or below, and cooling the blend. The improvement of this invention comprises the use of a high carbon ferrochromium and an oxygen and molybdenum bearing compound as the original materials.

5 Claims, No Drawings

METHOD FOR PRODUCING MOLYBDENUM BEARING FERROCHROMIUM

BRIEF SUMMARY OF THE INVENTION

The present invention relates to an improved method for producing a low carbon, low nitrogen molybdenum bearing ferrochromium. More specifically, the present invention is directed to a low carbon, low nitrogen molybdenum bearing ferrochromium produced by blending particles of a high carbon ferrochromium with particles of an oxygen and molybdenum bearing compound, vacuum heat treating the blended material, and cooling the blended material.

Vacuum induction melting of certain stainless steels containing molybdenum requires a low carbon, low nitrogen ferrochromium as a well as a source of molybdenum. Accordingly economically feasible sources of these materials must be found.

One possible method of producing low carbon ferrochromium is the Simplex process. Comminuted high carbon ferrochromium is treated with an oxygen bearing compound in a vacuum at a temperature below the melting points of the blended compounds. A solid state decarburization reaction occurs to yield carbon monoxide and a low carbon ferrochromium. The Simplex process is described in a paper "Manufacture of Simplex Ferrochrome by the Vacuum Process" by C. G. Chadwick, Transaction of the Vacuum Metallurgy Conference, 1963, pages 221–231.

A method of decarburizing high carbon ferrochromium which is similar to the Simplex process is described in Chadwick U.S. Pat. No. 2,541,153. Sordillo and Cazzaro U.S. Pat. No. 3,595,709 discloses a process for the production of ferrochrome alloys having a high nitrogen content and low carbon content. Nakamura, et al. U.S. Pat. No. 4,008,104 and a paper "Production of Ultra Low Nitrogen Ferrochrome and of High Purity Stainless Steel", H. Katayama, S. Kimura, H. Kajioka and M. Itoh, Transactions of the Iron and Steel Institute of Japan, Volume 19, No. 6, 1979, pp. 347–354, disclose the use of a molten flux for the removal of nitrogen from ferrochrome. Nakamura, et al. U.S. Pat. No. 4,050,960 discusses a method for decreasing the amount of carbon and nitrogen contained in a ferrochromium alloy by treating the alloy in a hydrogen stream. The above references do not teach the subject invention, although they are representative of the state of the art.

The nitrogen content of the ferrochromium may be reduced by treating the ferrochromium particles in a vacuum at elevated temperatures. The nitrogen is removed by the vacuum system as it diffuses from the ferrochromium.

Common sources of molybdenum are molybdenum metal and ferromolybdenum.

Due to the higher costs of low carbon ferrochromium and ferromolybdenum when compared with high carbon ferrochromium and molybdic oxide respectively, it is desired that high carbon ferrochromium and an oxygen and molybdenum bearing compound such as molybdic oxide be combined to produce a low carbon ferrochromium containing molybdenum.

Accordingly, an object of the present invention is to produce a low carbon ferrochromium containing molybdenum by combining a high carbon ferrochromium and an oxygen and molybdenum bearing compound.

An advantage of the present invention is the production of a low carbon, low nitrogen ferrochromium containing molybdenum from relatively low cost materials.

DETAILED DESCRIPTION

The present invention is directed to the production of a low carbon (less than 1.0% C), low nitrogen (less than 0.0300% N) ferrochromium containing molybdenum by blending a high carbon ferrochromium and an oxygen and molybdenum bearing compound. High carbon ferrochromium is crushed to particles, generally finer than 10 mesh. Particles of an oxygen and molybdenum bearing compound are mixed with the high carbon ferrochromium particles in an amount dependant upon the carbon content of the ferrochromium and the desired molybdenum content of the final product. Oxygen bearing compounds of other metals and alloys, especially oxides of iron, chromium and ferrochromium may be added if the amount of oxygen in the oxygen and molybdenum bearing compound which was added to the blend is insufficient to react with the carbon contained in the ferrochromium. The amount of oxygen required is based upon a relationship of four parts oxygen to three parts carbon by weight for the formation of carbon monoxide.

The blended particles are packed into a container or briquetted and heated in a vacuum chamber at a temperature of 1600° F. or over and a pressure of 10 torr or below. The temperature, time, and pressure necessary to achieve the desired result are functions of the amounts of carbon and nitrogen to be removed and the vapor pressures of the elements in the mixture. The charge is cooled in a protective atmosphere; e.g. a vacuum, after the amounts of carbon and nitrogen have been reduced to the desired levels.

The following examples are illustrative of the invention. They are directed to the use of molybdic oxide as the oxygen and molybdenum bearing compound. However, the invention is believed to be acceptable to other oxygen and molybdenum bearing compounds.

EXAMPLE I

A high carbon ferrochromium containing 5.98% carbon, 0.035% nitrogen, 1.52% silicon, 65.23% chromium, with a balance of iron was crushed to particles finer than 10 mesh. A blend of 80.71% ferrochromium and 19.29% molybdic oxide was then packed into low carbon steel cylinders and heated for 9.5 hours at 2250° F. in a vacuum furance at a pressure of 0.15 torr.

The top layers of three of the samples of the material had the following composition after the heat treatment.

| | Weight Percent | | |
|---|---|---|---|
| Sample | Carbon | Oxygen | Nitrogen |
| 1 | 0.42 | 0.95 | 0.0042 |
| 2 | 0.37 | 0.75 | 0.0020 |
| 3 | 0.52 | 0.93 | 0.0016 |

The results indicate that the amounts of all three of these elements present in the blend were significantly reduced by this process.

EXAMPLE II

A blend of the same composition as used in Example I was packed into an alumina dish and heated for 22 hours at 2250° F. in a vacuum furnace under a pressure of between 0.14 and 0.15 torr.

An analysis of the composition of scrapings from the top and bottom of the sample showed:

| | Weight Percent | | |
|---|---|---|---|
| Sample | Carbon | Molybdenum | Nitrogen |
| top | 0.28 | 12.82 | 0.0025 |
| bottom | 0.53 | 12.35 | 0.0024 |

These results indicate that molybdenum was not lost to evaporation during the vacuum treatment.

From the above paragraphs it will be apparent to those skilled in the art that the novel principles of the invention disclosed herein in connection with specific examples thereof will suggest various other modificiations and applications of the same. It is accordingly desired that in construing the breadth of the appended claims they should not be limited to the specific examples described herein.

I claim:

1. A method for producing a low nitrogen, low carbon ferrochromium containing molybdenum comprising the steps of blending particles of a material consisting essentially of a high carbon ferrochromium and particles of an oxygen and molybdenum bearing compound, heat treating the blend in a vacuum at a temperature of 1600° F. or over and a pressure of 10 torr or below and cooling the blend.

2. A method according to claim 1 wherein the oxygen and molybdenum bearing compound is molybdic oxide.

3. A method according to claim 1 where the heat treating occurs at a pressure of about 0.15 torr.

4. A method according to claim 1 where the heat treating occurs at a temperature of about 2250° F.

5. A method according to claim 1 where the other oxygen containing compound is from the group consisting of oxides of iron, chromium and ferrochromium.

* * * * *